US012366120B2

(12) United States Patent
Anderson et al.

(10) Patent No.: US 12,366,120 B2
(45) Date of Patent: Jul. 22, 2025

(54) HANDHELD WATER DRILL AND METHOD

(71) Applicant: Vermeer Manufacturing Company, Pella, IA (US)

(72) Inventors: Thor Anderson, Monroe, IA (US); Logan Peters, Pleasant Hill, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 18/535,958

(22) Filed: Dec. 11, 2023

(65) Prior Publication Data

US 2024/0200409 A1 Jun. 20, 2024

Related U.S. Application Data

(60) Provisional application No. 63/476,074, filed on Dec. 19, 2022.

(51) Int. Cl.
*E21B 11/00* (2006.01)
*E21B 7/18* (2006.01)
*E21B 7/20* (2006.01)

(52) U.S. Cl.
CPC ..... *E21B 11/005* (2013.01); *E21B 7/18* (2013.01); *E21B 7/20* (2013.01)

(58) Field of Classification Search
CPC ..... E21B 7/18; E21B 7/20; E21B 11/005
See application file for complete search history.

(56) References Cited

U.S. PATENT DOCUMENTS

| | | | | |
|---|---|---|---|---|
| 5,016,717 | A | 5/1991 | Simons et al. | |
| 6,273,512 | B1 | 8/2001 | Rajewski | |
| 6,470,605 | B1 * | 10/2002 | Gilman | E21B 7/18 37/323 |
| 9,556,692 | B1 * | 1/2017 | Cordova | E21B 21/16 |
| 2003/0000744 | A1 | 1/2003 | Chizek, Sr. | |
| 2019/0024458 | A1 * | 1/2019 | Chichester-Constable | E21B 11/005 |

FOREIGN PATENT DOCUMENTS

EP 0496481 A2 7/1992

OTHER PUBLICATIONS

Extended European Search Report for Application No. 23216203.2 dated Apr. 2, 2024 (7 pages).
Common Ground Alliance, Best Practices, available as early as Nov. 9, 2022, https://www.digalert.org/pdfs/bestpractices.pdf (128 pages).
(Continued)

*Primary Examiner* — Dany E Akakpo
(74) *Attorney, Agent, or Firm* — Michael Best & Friedrich LLP

(57) ABSTRACT

A water drilling system includes a handheld wand having a handle portion and a distal tip. A hose connects the handheld wand to a pressurized water source. The handheld wand is controllable to selectively discharge pressurized water from a nozzle at the distal tip. A non-metallic hollow shaft of the handheld wand is configured to be thrust into ground soil. The hollow shaft extends between the handle portion and the distal tip, and the hollow shaft has an outside diameter less than an outside diameter of the distal tip.

21 Claims, 16 Drawing Sheets

(56) References Cited

OTHER PUBLICATIONS

Facebook, post from Andrew Zubia in "Hydrovac Nation" Private Group, Dec. 13, 2021, https://www.facebook.com/groups/hydrovacnation/permalink/1761618334183766/?mibextid=W9rl1R.
Georgia Underground, "48" Utility Probe Blunt Tip," accessed on Nov. 9, 2022, https://georgiaunderground.net/products/48-utility-probe-blunt-tip.html (website no longer live).
GPR OneCall, What is Soft Dig Excavation, available as early as May 22, 2022, https://gpronecall.com/uncategorized/what-is-soft-dig-excavation (archived).
IrrigationRepair.com, "How to Dig & Run Pipe Under Driveway or Sidewalk," available as early as Apr. 28, 2010, https://www.irrigationrepair.com/how_to_dig_and_run_pipe_under_driveway_or_sidewalk.html.
MightyProbe—T&T Tools, Inc., "Water Probe," available as early as Aug. 9, 2020, https://mightyprobe.com/collections/probes/products/water-probe.
SBCA Tree Consulting, "Water Jet," available as early as Jan. 23, 2016, http://sbcatree.com/water-jet.html (archived).
Texas Administrative Code, Title 16, Part 1, Rule § 18.2, effective Sep. 1, 2007 (3 pages).
YouTube, Water-Jetting: An Instructional Video, May 18, 2016, https://www.youtube.com/watch?v=UA3tyD1s2Rk.

* cited by examiner

HANDHELD WATER DRILL AND METHOD

CROSS-REFERENCE TO RELATED APPLICATIONS

This application claims the benefit of priority to U.S. Provisional Patent Application No. 63/476,074, filed on Dec. 19, 2022, the entire contents of which are incorporated by reference herein.

BACKGROUND

The present invention relates to tools and methods for locating subterranean objects and/or installing subterranean utilities (e.g., gas lines, water or sewer lines, etc.).

Prior to excavating a site containing soil over top of existing utilities, or an area with unknown utilities or other buried objects, it may be necessary to identify the location of any existing objects, such as utilities or other potential obstacles. In some cases, the objective may be to identify the location of the utilities so that they can be excavated. In other cases, the objective may be to identify the location of the utilities so that they can be avoided. Although some electronic locating tools and method are available, they may have relatively large tolerances (e.g., +/−457 mm (18 inches)) preventing precision excavation. "Soft digging" or "soft excavation" is required in such situations to avoid damaging any existing utilities. These "soft" operations can include manually excavating with one or more workers handling shovels or other tools. Other soft operations not relying solely on manual labor include vacuum excavation with a dig tube. These soft operations generally pose little risk for damaging existing utilities, but require opening of the ground and soil removal, thus creating potholes, to visually identify the existing utilities.

Once a site is at least partially excavated and existing underground objects have been identified, larger tools can be employed for further excavation and/or boring for utility line installation. In some cases, these tools are also used for installing the utility line. Existing tools include excavators, trenchers, horizontal directional drills (HDD), moles (pneumatic or hydraulic), and small drilling devices known as porta-bore. Any of these tools pose a risk to existing utilities if accidentally contacted due to malfunction or human error. Existing tools are either large and destructive, or small and difficult or impossible to steer.

In some HDD operations, it may be required to perform "potholing" during or after underground boring. Potholing involves the excavation of the ground to expose a utility for visual confirmation of its location and that the HDD boring did not come into contact or cause damage.

Whether created before or after the primary working operations, the potholes may become excessively large or numerous, especially if the object or utility is not in the expected location. Thus, a need exists for a soft excavation device and method that is effective yet capable of reduced soil disruption (e.g., smaller diameter holes, less spoils brought to the surface, etc.) and/or reduced labor in achieving the basic objectives currently met by potholing.

SUMMARY

In one aspect, the invention provides a water drilling system includes a handheld wand having a handle portion and a distal tip. A hose connects the handheld wand to a pressurized water source. The handheld wand is controllable to selectively discharge pressurized water from a nozzle at the distal tip. A non-metallic hollow shaft of the handheld wand is configured to be thrust into ground soil. The hollow shaft extends between the handle portion and the distal tip, and the hollow shaft has an outside diameter less than an outside diameter of the distal tip.

In another aspect, the invention provides a method of operating a water drilling system. A hose is connected to a handheld wand having a handle portion and a distal tip, the hose supplying pressurized water into the handheld wand. A trigger at the handle portion is operated to selectively discharge the pressurized water from a nozzle at the distal tip. The pressurized water is conveyed through a non-metallic hollow shaft that connects the handle portion and the distal tip. While operating the trigger, the distal tip and the hollow shaft of the handheld wand are thrust into the ground and used for probing to locate an underground utility by contact therewith during the thrusting.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
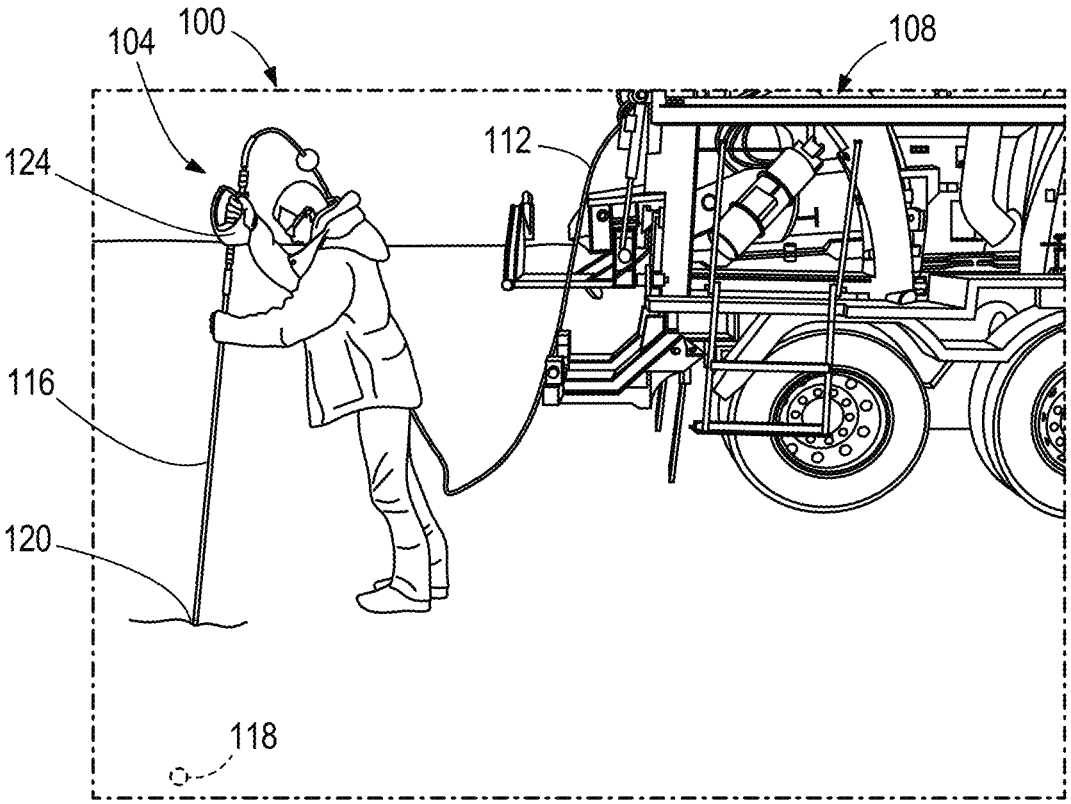
FIG. 1 is a first view of a water drilling system, including a handheld water drill being probed into the ground.
Figure 2:
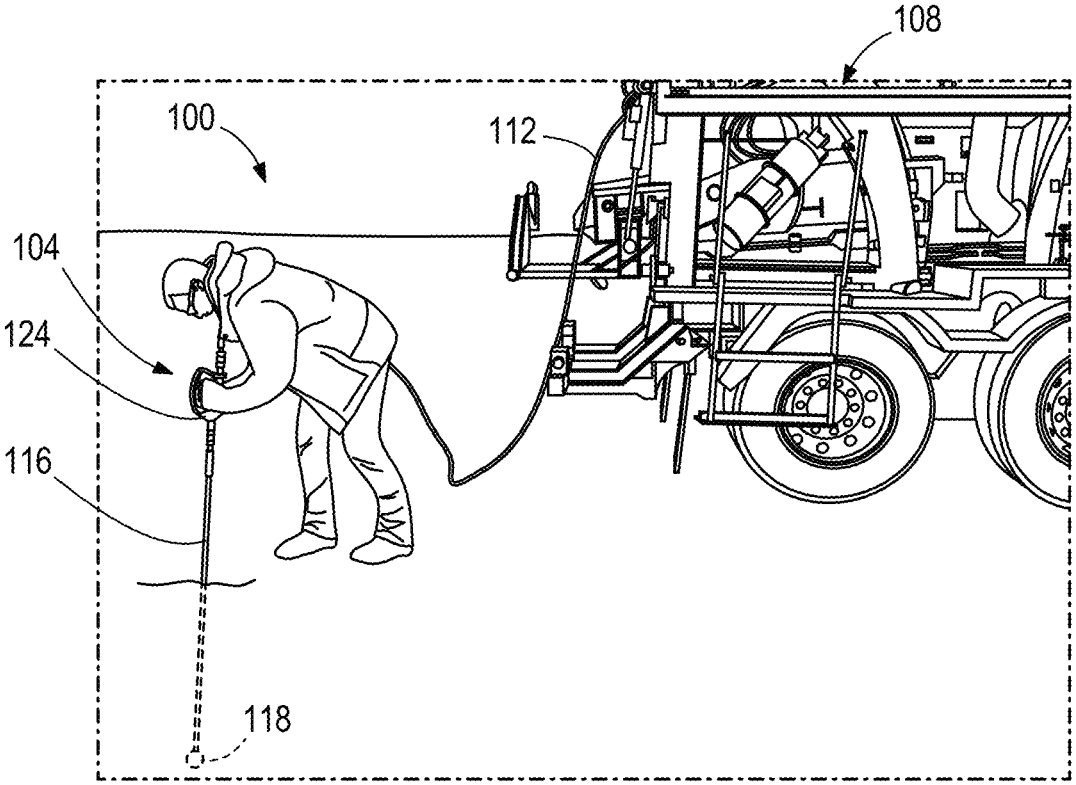
FIG. 2 is a second view of the water drilling system of FIG. 1 in which the handheld water drill is manually thrust to a greater depth in the ground.

FIGS. 1 and 2 illustrate a water drilling system 100 according to one construction of the present disclosure. The water drilling system 100 includes a handheld water drill 104 or "wand" along with a high-pressure water source 108. The high-pressure water source 108 can take numerous forms, including those of conventional construction. The high-pressure water source 108 can include a tank or reservoir and one or more pumps. The high-pressure water source 108 can be mobile (e.g., mounted on or built into a truck or trailer on wheels). In the system 100 illustrated in FIGS. 1, 2, and 14, the high-pressure water source 108 can be part of a hydro-vacuum excavation truck. The high-pressure water source 108, particularly pumps thereof, may be powered by a prime mover separate from the vacuum excavator, or may be powered by the vacuum excavator (e.g., powered by the engine or electrical system of the vacuum excavator).

Figure 6:
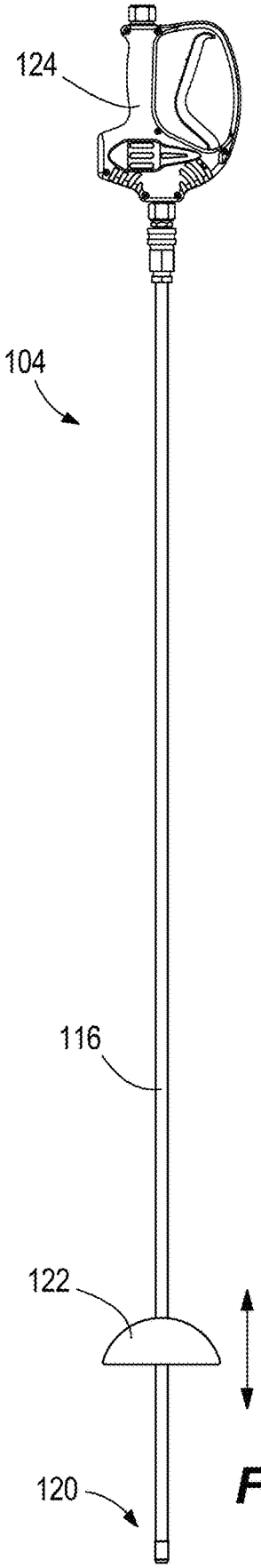
FIG. 6 is a side elevation view of the handheld water drill.

The handheld water drill 104 is connected to the high-pressure water source 108 with a hose 112. As such, the hose 112 supplies water from the high-pressure water source 108 to the handheld water drill 104, which may be referred to hereinafter as the wand 104. As can be seen in FIGS. 1 and 2, the wand 104 includes an elongate hollow shaft 116 (also referred to as a "lance" or "wand body") configured to be plunged or thrust into ground soil. FIG. 1 illustrates the operator beginning a probing of the ground toward a pre-installed utility 118, and FIG. 2 illustrates the operator having thrust approximately half of the wand length into the ground. As discussed in further detail below, the thrust for probing with the wand 104 is provided solely by the operator, i.e., manual thrust along the axis of the shaft 116. In combination with the operator's manual thrust, water is ejected from a distal tip portion 120 of the wand 104 to cut away the soil. A spray shield 122 can be slidably received on the shaft 116 as shown in FIG. 6 to cover the aperture made in the ground as the wand 104 thrusts inward. The spray shield can be made of a suitable material such as rubber or plastic.

Figure 7:
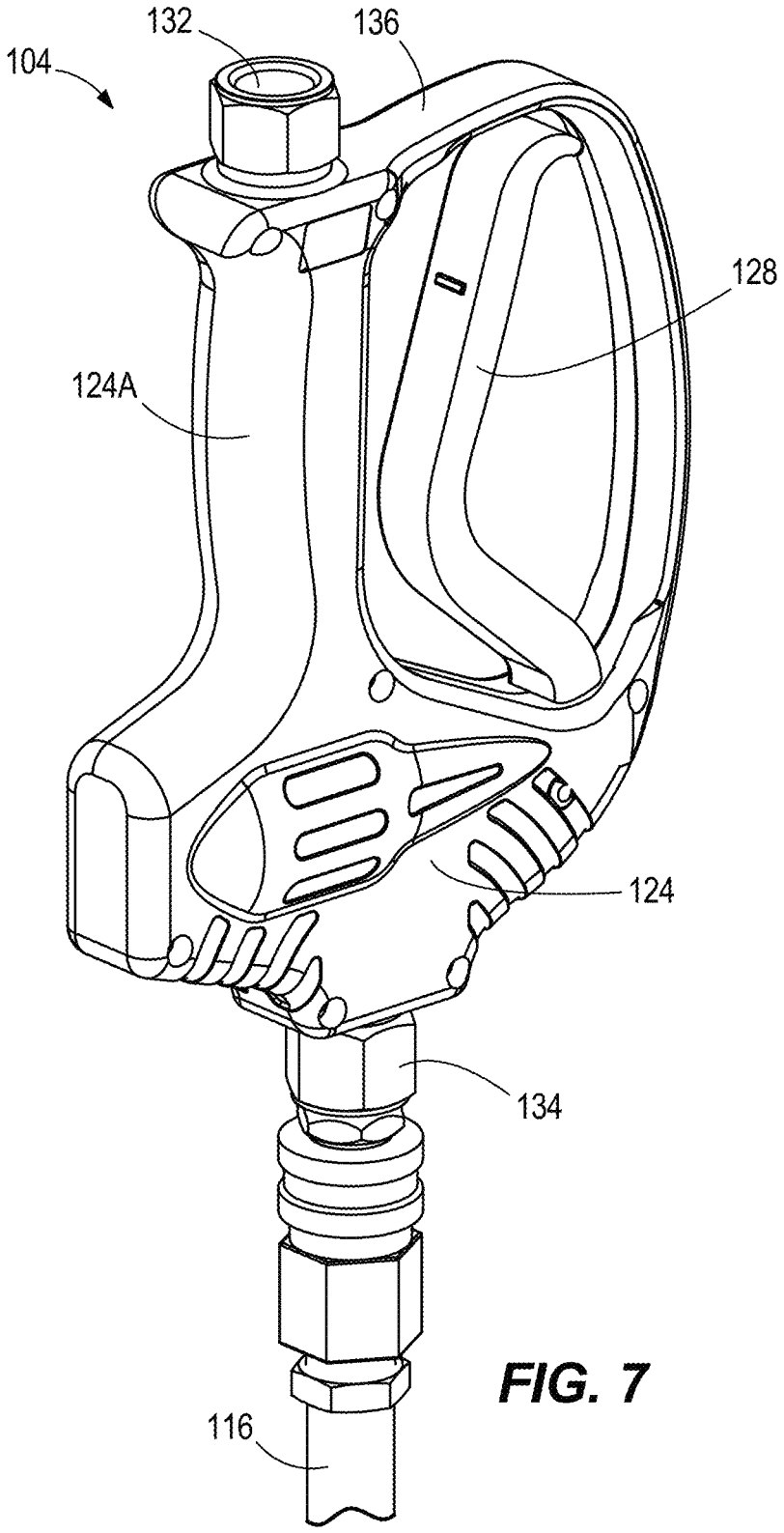
FIG. 7 is a detail view from FIG. 3 of the operator's grip or handle portion of the handheld water drill.
Figure 8:
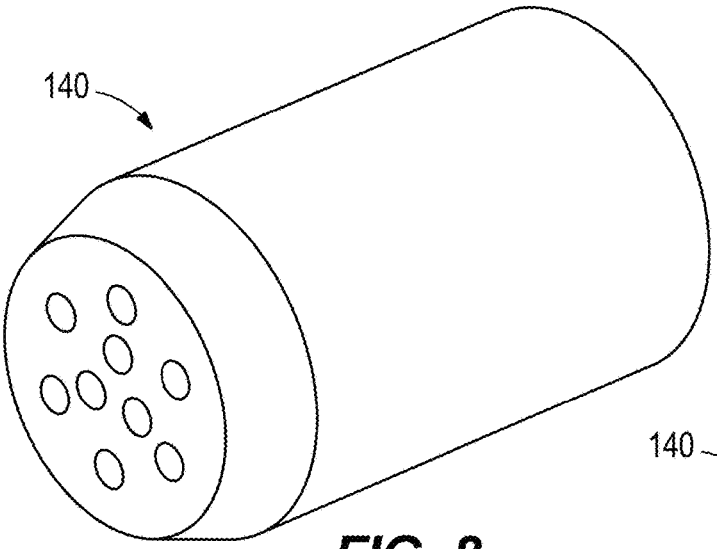
FIG. 8 is a perspective view of a nozzle of the handheld water drill.
Figure 9:
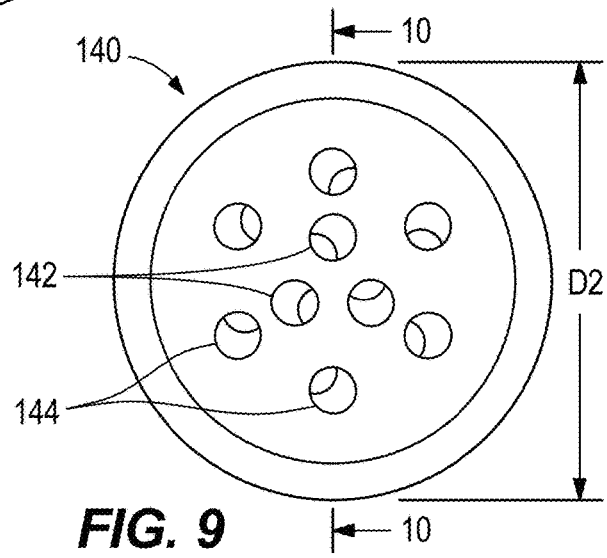
FIG. 9 is an end view of the nozzle of FIG. 8.

Axially or lengthwise-opposite the distal tip portion 120, the wand 104 includes an operator's grip or handle portion 124, shown in greater detail in FIG. 7. Water ejection can be controlled (on/off or variably) by a control member such as a trigger 128 provided at the handle portion 124 (e.g., adjacent or within the handle portion). In some constructions, the trigger 128 can be surrounded by a guard portion of the handle portion 124, either partially or fully encircled. The handle portion 124 can be of a cast or machined metal construction in some embodiments. The handle portion 124 of the wand 104 can include a main grip portion 124A configured to fit within the palm of the operator's hand. The trigger 128 can be moved into an actuated position toward or against the main grip portion 124A to be grasped and maintained actuated while holding the main grip portion 124A. The handle portion 124 can include a first connection structure 132 for mating with the hose 112. The handle portion 124 can further include a second connection structure 134 for mating with the shaft 116. The connection structures 132, 134 are shown opposite each other on the illustrated handle portion 124. In other constructions, where the second connection structure 134 to the shaft 116 forms a bottom portion, the first connection structure 132 can be positioned on a side, front, or rear of the handle portion 124. The connection structures 132, 134 provide mechanical and fluid connections, the fluid connections being sealed to prevent leakage of high-pressure water. In some constructions, one or both of the connection structures 132, 134 are quick-couplers that require no tools and only simple hand operations to connect and disconnect. A top end 136 of the handle portion 124 can provide a pressing surface (e.g., flat surface) for the operator to apply thrust force during use.

Figure 3:
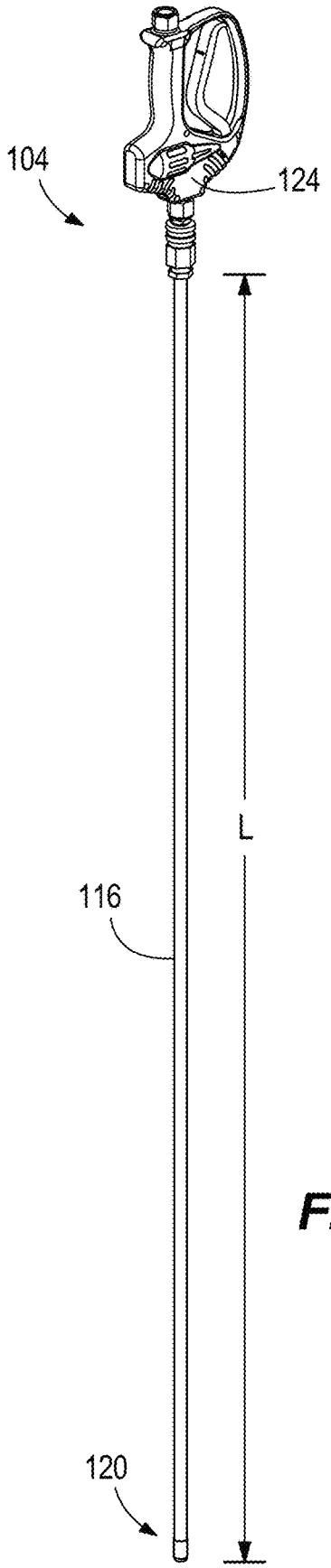
FIG. 3 is a first perspective view of the handheld water drill shown in FIGS. 1 and 2.
Figure 4:
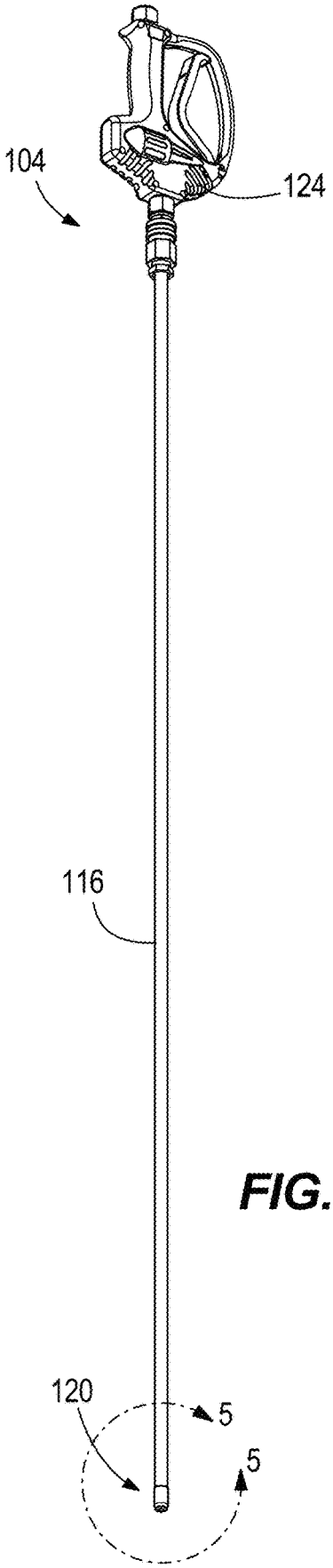
FIG. 4 is a second perspective view of the handheld water drill.
Figure 5:
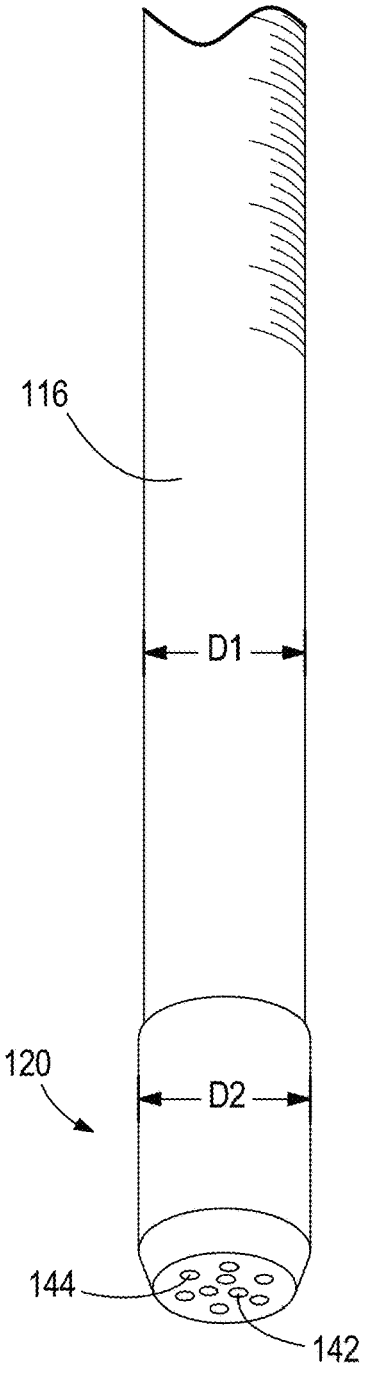
FIG. 5 is a detail view from FIG. 4 of a distal tip portion with nozzle of the handheld water drill.

In order to reduce the soil impact of using the wand 104, the shaft 116 has a relatively small outside diameter D1. For example, the shaft outside diameter D1 is less than 50 mm (2.0 in), and in some constructions less than 25 mm (1.0 in). In some constructions, the shaft outside diameter D1 is no more than about 19 mm (0.75 in). In some constructions, the shaft outside diameter D1 is no more than about 12.7 mm (0.50 in). In some constructions, the shaft outside diameter D1 is in a range of 9.5 mm (0.375 in) to 15.9 mm (0.625 in). Although a thin shaft is preferable for minimal soil disturbance, the shaft 116 can have an outer diameter D1 of at least 6.4 mm (0.25 in) in order to resist buckling under column loading conditions when thrust into the ground. As shown in FIG. 5, the outside diameter D2 of the distal tip portion 120 is larger than the outside diameter D1 of the shaft 116. For example, the outside diameter D2 of the distal tip portion 120 can be about 12 mm (0.47 in) to 27 mm (1.06 in). In some constructions, the outside diameter D2 of the distal tip portion 120 is 15.9 mm (0.625 in)+/−2.5 mm (0.1 in). The ratio of D2:D1 can be at least 1.1 and not more than 2.0, 1.75, or 1.5. In some constructions, the ratio of D2:D1 is in the range of 1.15 to 1.40. In some constructions, the ratio of D2:D1 is in the range of 1.2 to 1.3 (e.g., 1.25). The slightly enlarged distal tip portion 120 clears the path for the shaft 116, reducing the amount of soil friction along the shaft 116. The wand 104, and particularly the respective outside diameters D1, D2 of the shaft 116 and distal tip portion 120, is configured such that fluid, which may include water and/or slurry, in the bore hole (i.e., in the interstitial space between the shaft 116 and bore hole) may serve to lubricate the movement of wand 104 during penetration and withdrawal. As shown in FIG. 3, the wand 104 has a length L that greatly exceeds the diameters D1, D2 (e.g., L:D2 at least 30, at least 40, or at least 50). The wand length L, or effective probe length, can include the ground-penetrating portions only, i.e., the shaft 116 and the distal tip portion 120, but not the handle portion 124. The above dimensions and ratios that relate to the shaft 116 can be applicable for a majority or in some cases an entirety of the length L, rather than merely a localized portion.

The shaft 116 can be constructed from any one or more of numerous suitable materials, including non-metallic materials. In some constructions, the shaft 116 is made of carbon fiber, fiberglass, polyimide, nylon, PEI (e.g., Ultem®), PTFE, PEEK, PPSU, PES, PEED, PVDF, PET-P (Ertalyte®), silicon nitride, fused quartz, or epoxy-fiberglass (e.g., G10 or garolite). Certain materials, including but not limited to nylon, PEEK, and PPSU, may be reinforced with a filler material such as glass or carbon fiber. In some embodiments the filler is present in a quantity of 20-40% by weight (e.g., 30% by weight). A lighter weight of the shaft 116 allows better operator feel during use, when compared to a heavy shaft, so the user can more easily detect contact with objects (i.e., changes are more discernable as the user applies downward force). The shaft 116 may be constructed of an electrically non-conductive material, or a material having high electrical resistivity. The resistivity of the wand 104 is greater than the resistivity of the water directed through the wand 104. In particular, the resistivity of the shaft 116 is greater than the resistivity of the water directed through the wand 104. In some constructions, the resistivity of the shaft 116 (e.g., and that of the wand 104 overall) is at least 1000 Ωm, or at least 10,000 Ωm. In some constructions, the resistivity of the shaft 116 (e.g., and that of the wand 104 overall) is orders of magnitude higher, such as $1\times10^{7}$ Ωm to $1\times10^{14}$ Ωm. The material for the distal tip portion 120 can be different from that of the shaft 116. In some constructions, the material for the distal tip portion 120 is a harder, more wear-resistant material than that of the shaft 116. Some exemplary materials for the distal tip portion 120 include zirconia, ceramic, and tungsten carbide.

The distal tip portion 120 forms a blunt end rather than a sharp tip. Rather than mechanically cutting or wedging into the soil by a sharp tip or edge, the wand 104 relies on the jet(s) of water for cutting away the soil to allow the insertion of the shaft 116. The water jet(s) are effective at cutting into the soil to form a small hole suitable for probing, without being overly destructive. In other words, the wand 104 prevents the need to excavate and physically remove soil away from the location of interest. There is no open pit and no additional pile of spoils when using the wand 104. Furthermore, the water jet(s), while effective for cutting the soil, are harmless to the utilities for which the wand 104 is probing. This is unlike conventional powered tools that are likely to include sharp points or bits. Moreover, the wand 104 is not a spinning tool and need not be put into rotation in order to pierce the ground. It can be solely thrust into the ground, without rotation. The water pressure to the wand 104 should be at least 69 bar (1000 psi). In most constructions, the water pressure does not exceed 276 bar (4000 psi). In some constructions, the water pressure is in a range of 69 bar (1000 psi) to 207 bar (3000 psi). More particularly, the water pressure may be in a range of 124 bar (1800 psi) to 172 bar (2500 psi). Operational methods can include adjusting the water pressure based on soil conditions, the adjustments being made as an initial setting prior to use of the wand 104 and/or after observing initial operation of the wand 104. Water pressure may be adjusted upwardly if the wand 104 cuts too slowly into the ground, and water pressure may be adjusted downwardly if the use of the wand 104 results in excessive spray of water and/or spoils out of the ground.

Figure 10:
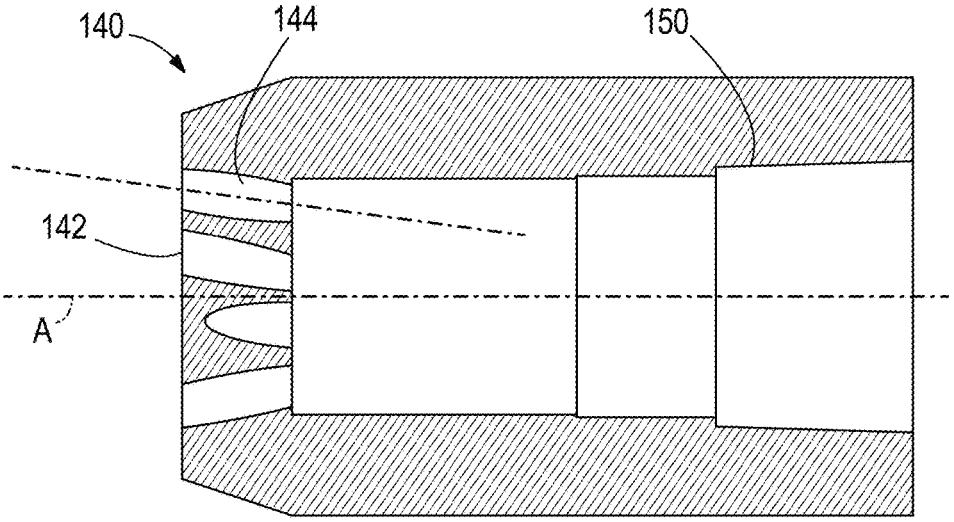
FIG. 10 is a cross-section view of the nozzle taken along line 10-10 of FIG. 9.

With reference to FIGS. 5 and 8-10, the distal tip portion 120 can include a nozzle 140 including a plurality of nozzle apertures. In some constructions, the distal tip portion 120 is formed solely by the nozzle 140. As illustrated, each of the nozzle apertures has an at least partially (e.g., predominantly) axial orientation. The nozzle apertures can include inner nozzle apertures 142 and outer nozzle apertures 144. The inner and outer nozzle apertures 142, 144 can have angular orientations that are different from each other. The apertures may create a spiral spray pattern. For example, the outer nozzle apertures 144 can have a greater divergence angle with respect to a central axis A. The divergence angle of the outer nozzle apertures 144 can be in a range of 6 to 12 degrees, or more particularly 8 to 10 degrees. The divergence angle of the inner nozzle apertures 142 can be less than half the divergence angle of the outer nozzle apertures 144. In some constructions, the inner nozzle apertures 142 have a divergence of less than 3 degrees from the central axis A. In some constructions, the apertures may have a straight spray pattern where the inner nozzle apertures 142 have a divergence angle of zero degrees, therefore being parallel to the central axis A. As shown in FIG. 10, the nozzle 140 can include a counterbore receptacle 150 configured to receive the end of the shaft 116. The nozzle 140 can be fixedly connected to the shaft 116 by an end connector (not shown) affixed to or integrated into the shaft 116 or by other suitable means (e.g., bonded, threaded, secured by quick-connect structures) to contain and direct the pressurized water and to withstand the external loads encountered during use. The nozzle 140 can be one of a plurality of removable, exchangeable nozzles to be used in different operations and/or different soil conditions.

Figure 11:
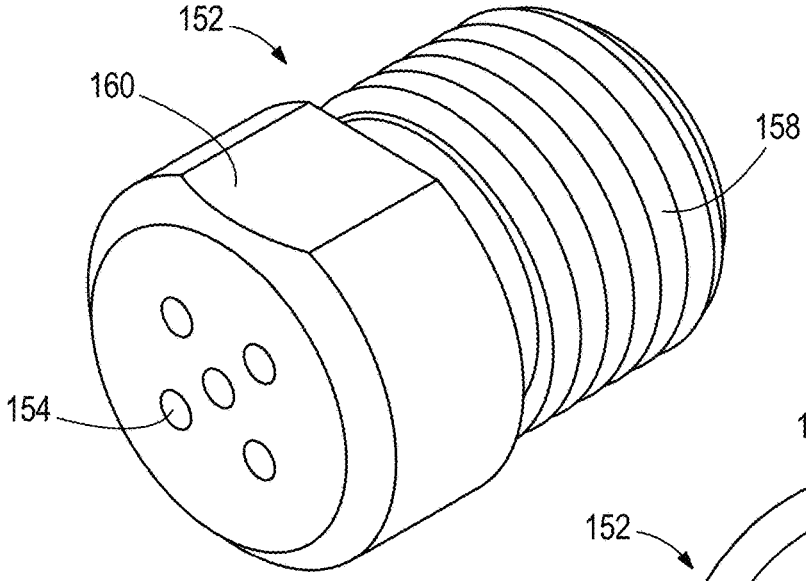
FIG. 11 is a perspective view of a nozzle according to another embodiment.
Figure 12:
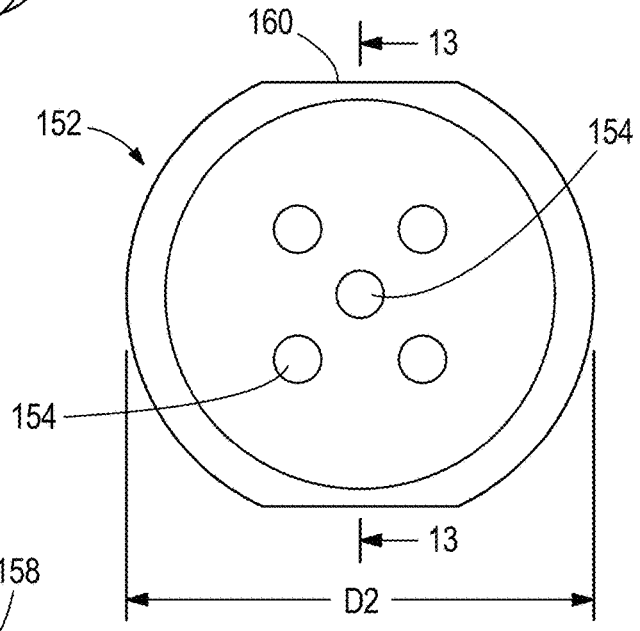
FIG. 12 is an end view of the nozzle of FIG. 11.
Figure 13:
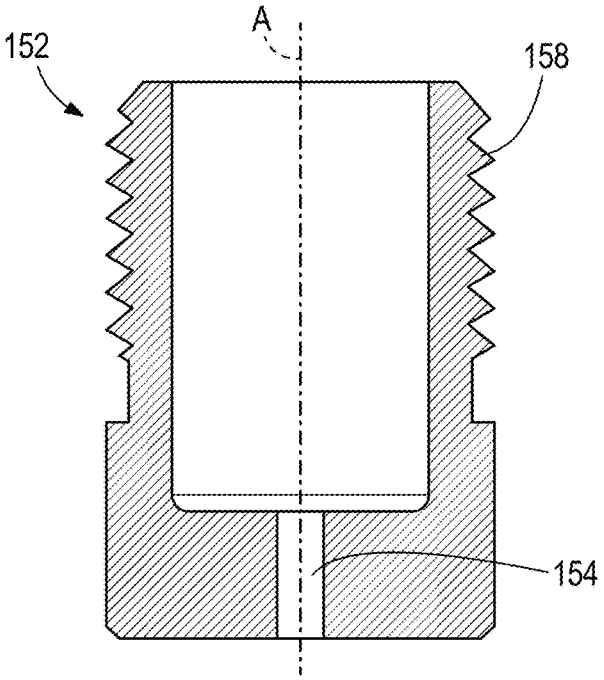
FIG. 13 is a cross-section view of the nozzle taken along line 13-13 of FIG. 12.

FIGS. 11-13 illustrate an alternate nozzle 152 that can be used with a wand and system as described elsewhere herein. The nozzle 152 includes a plurality of nozzle apertures 154. In some constructions, the distal tip portion 120 is formed solely by the nozzle 152. As illustrated, each of the nozzle apertures 154 has a straight axial orientation, parallel to the central axis A. The nozzle apertures 154 can include a central nozzle aperture 154 and a plurality of additional or peripheral nozzle apertures 154 (e.g., spaced equally from the central nozzle aperture 154). There are five nozzle apertures 154 in the illustrated embodiment, but the number of nozzle apertures may be greater or fewer than five in other embodiments. In some embodiments, some or all of the nozzle apertures 154 may have a divergence angle (e.g., similar to the nozzle 140 of FIGS. 8-10). As shown in FIG. 10, the nozzle 152 can include a connection structure 158 (e.g., threaded portion) configured to engage with the end of the shaft 116. In the illustrated construction, the connection structure 158 is a male threaded portion. The nozzle 152 can include features 160 such as wrench flats on an exterior profile thereof so that the nozzle 152 can easily be gripped for torque application for assembly and/or disassembly. In the illustrated construction, the nozzle 152 has a round or circular profile with the exception of the wrench flats 160.

The nozzle 152 and the shaft 116 can be fixedly secured together (e.g., bonded, threaded, secured by quick-connect structures) by suitable means to contain and direct the pressurized water and to withstand the external loads encountered during use. Details of exemplary means of securement are described in further detail below, particularly with reference to FIGS. 17-20. The nozzle 152 can be one of a plurality of removable, exchangeable nozzles to be used in different operations and/or different soil conditions. In some constructions, a nozzle similar to the nozzles illustrated and described herein may be provided with a singular aperture for discharging the water.

Figure 15:
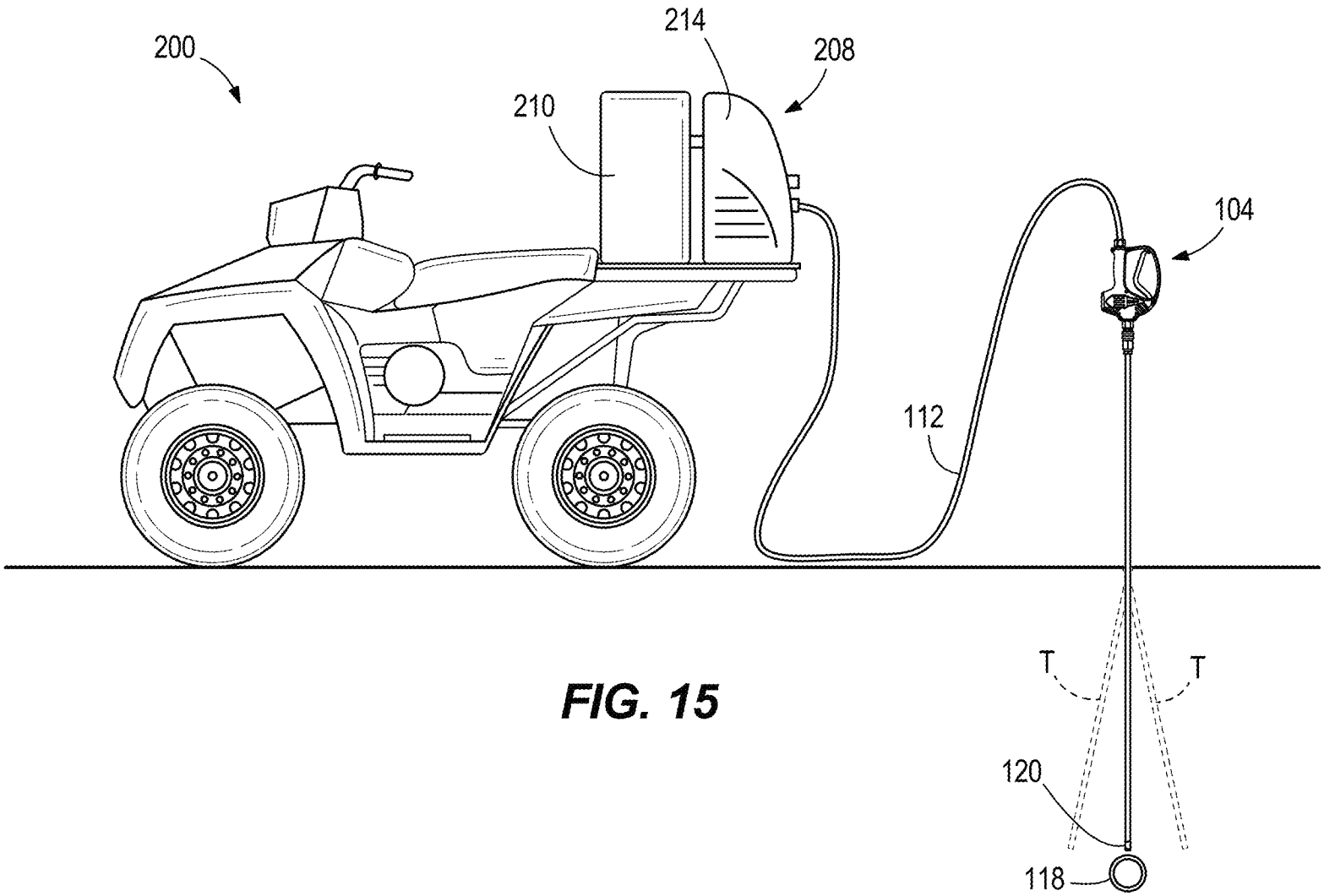
FIG. 15 illustrates a water drilling system carried by a personal transport vehicle, such as an all-terrain vehicle (ATV).

As noted above, the wand 104 can be connected to a hydro-vacuum excavation truck. This is one example of a road-going vehicle capable of legal travel about public roadways or highways. FIG. 15 illustrates a water drilling system 200 according to another construction of the present disclosure is a smaller and more maneuverable version of the system 100—one that can be better suited for off-road and/or remote access locations. The water drilling system 200 includes the wand 104 along with a high-pressure water source 208 that is temporarily or permanently mounted onto a personal transport device (e.g., a small off-road vehicle configured for carrying 1 or 2 people). In some constructions, the system 200 includes a commercially available all-terrain vehicle (ATV). The high-pressure water source 208 can be an active water source configured to selectively operate to generate high-pressure water (e.g., pump(s) driven from a prime mover such as an electric motor or gas-powered engine—either standalone or that which provides power to drive the vehicle). FIG. 15 illustrates the high-pressure water source 208 including a water tank 210 (for unpressurized water) and a self-contained pumping device 214 having a fluid connection to receive water from the water tank 210.

Figure 14:
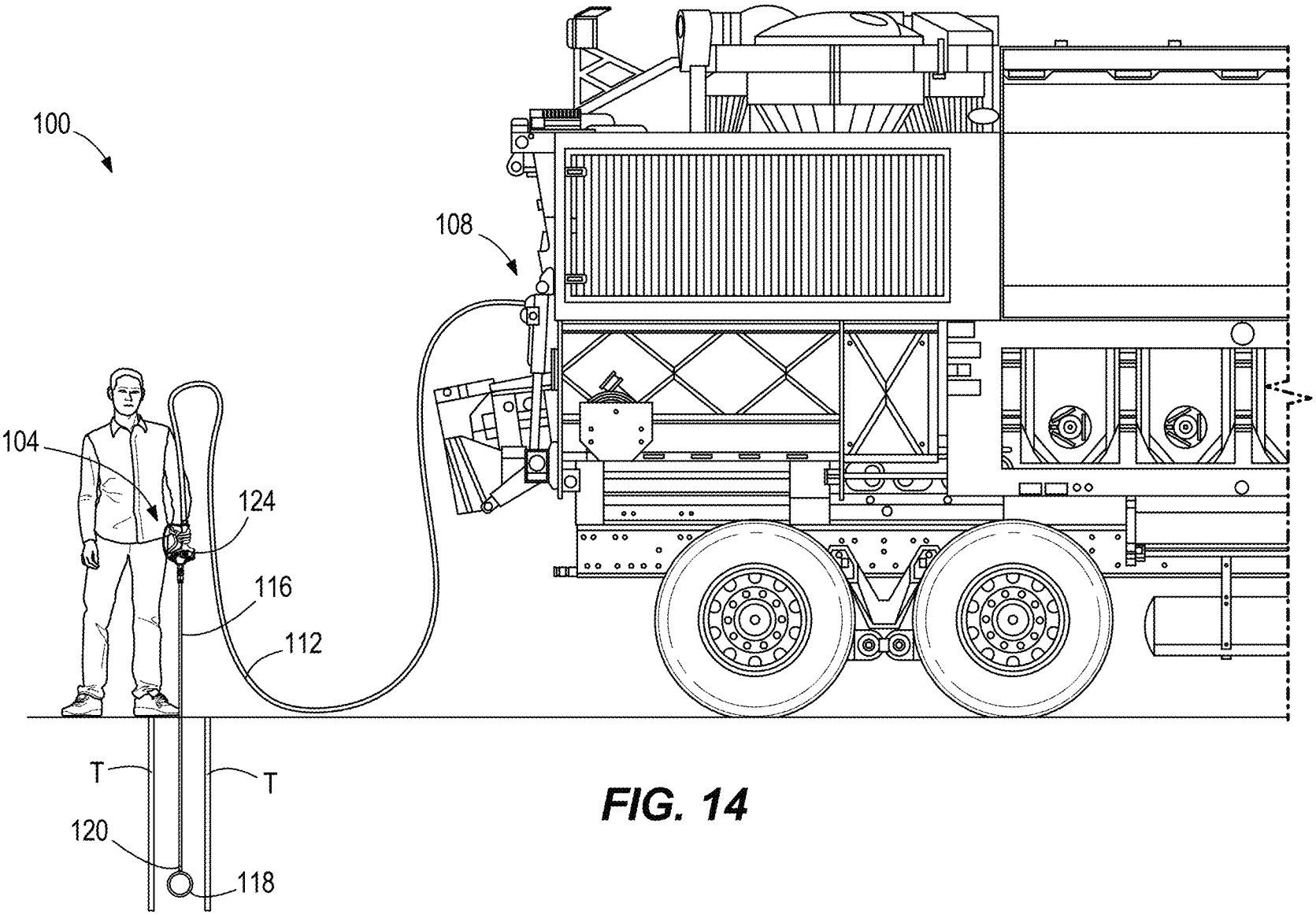
FIG. 14 illustrates a worker using the wand of the handheld water drill, connected with a hydro-vacuum excavator truck, to probe for an in-ground utility.

A non-destructive probing operation with the water drilling system 100 shown in FIGS. 1, 2, and 14, or the water drilling system 200 shown in FIG. 15, includes the following steps. The wand 104 is transported, along with the pressurized water source 108 or 208, to a work site. The work site may be pre-marked for underground utilities in some constructions. The worker connects the wand 104 to the pressurized water source 108 or 208, if not already connected. Likewise, the pressurized water source 108 or 208 is operated to pressurize the water, if not already pressurized. It will be appreciated that the systems 100, 200 can be transported in ready-to-use state, or alternately made ready at the site of the probing. When the system 100, 200 is ready or "charged," operation of the trigger 128 will produce water jets from the distal tip portion 120. The operator selects a ground location for probing, which may be selected on or near a marking established from other means. The objective of probing can be to identify the precise location of a buried object, or to confirm the absence of buried objects at a specific location. A non-exhaustive list of possible buried objects includes: utility lines (e.g., natural gas, water, communications, etc.), drainage tiles such as agricultural drainage tile, natural obstacles such as rocks encountered during other drilling or excavation processes, manmade obstacles such as the foundation of an above-ground construction (e.g., building, power pole, etc.). Water drilling or "probing" with the wand 104 can be used to understand how large a buried object is (by identifying its outer limits through probing contact) so that the trencher or HDD can steer around it. The probing can also be used when potholing during/after HDD bore formation, for example to allow very precise potholes to be excavated for visual confirmation of avoidance of contact or damage.

The operator places the distal tip portion 120 on the ground at the selected location and holds the wand 104 such that the shaft 116 is vertical (perpendicular to the ground). However, it is noted that some probing operations may call for probing at skewed angles rather than strictly vertical (e.g., to avoid a shallower utility or obstacle such as a tree root). With the wand 104 in the desired probing orientation, the operator actuates the trigger 128. While maintaining the trigger 128 actuated, the operator manually applies thrust load to the wand 104. With the trigger 128 actuated and thrust load applied, the wand 104 cuts into the soil and creates a localized path or bore that is nominally larger than the outer diameter D2 of the distal tip portion 120. In some constructions, the wand 104 forms a bore that is about 3 mm (0.12 in) to about 6.4 mm (0.25 in) larger than the outside diameter D2 of the distal tip portion 120. This allows for a reasonable thrust load (e.g., 54 kg (120 lbs.) or less, or 45 kg (100 lbs.) or less) to probe the wand 104 into the ground—up to and including the entire length L. Probing the wand 104 its full length into the ground can be accomplished, depending on soil type, in less than 60 seconds, and in some cases less than 30 seconds or less than 20 seconds. The soil from which the bore is formed is largely not removed from the ground. Rather, it is simply broken up along the path of the probing, and generally compacted in the immediate surroundings. The operator pulls the wand 104 backward out of the ground following a probe. Minimal spoils, including soil and water, may be ejected from the ground to the surface during probing. In some cases, depending upon soil conditions, spoils cease to surface above ground after an initial insertion depth of the wand 104 (e.g., after 76 mm (3 in.), after 152 mm (6 in.), or after 305 mm (12 in.)). If the probing is aimed such that it comes into contact with the utility 118, the probing is obstructed, and the operator can feel the contact to detect the utility 118. The water does not damage the utility 118. Of course, the utility 118 is merely one example of an underground object that the operator may be probing for in the soil.

The views of FIGS. 14 and 15 illustrate several prior probe tracks T or "misses," including tracks left and right of the final probe track in which the distal tip 120 of the wand 104 makes contact with the utility 118. FIG. 15 in particular shows a method in which multiple probe tracks T are formed at different angles (which may optionally include one that is straight vertical), all of which utilize a single entry point in the ground. Once the utility 118 is contacted, its precise location underground can be used for improved marking and/or immediate precision excavation. Not only is the plan view location of the utility 118 determined from probing, but also its depth by taking note of the exposed length of the wand 104 at the time of contact. The wand 104 can have an integrated depth scale (e.g., printed or engraved length markings), an example of which is shown in FIG. 5. Due to its minimal impact to the ground during operation, there may be no required backfill and no required removal of spoils following use of the wand 104 (e.g., ground disruption of an amount less than that which may trigger local regulations for remedial action). In other words, the probing with the wand 104 does not necessitate any remedial processing following use, and the ground can be left as-is following use. This can have a very significant impact on the required time (and also cost) for this phase of the job. Not only does the wand 104 allow quicker actual determination of the object compared to conventional methods, but the conventional methods also require management and often removal of the spoils.

Figure 16A:
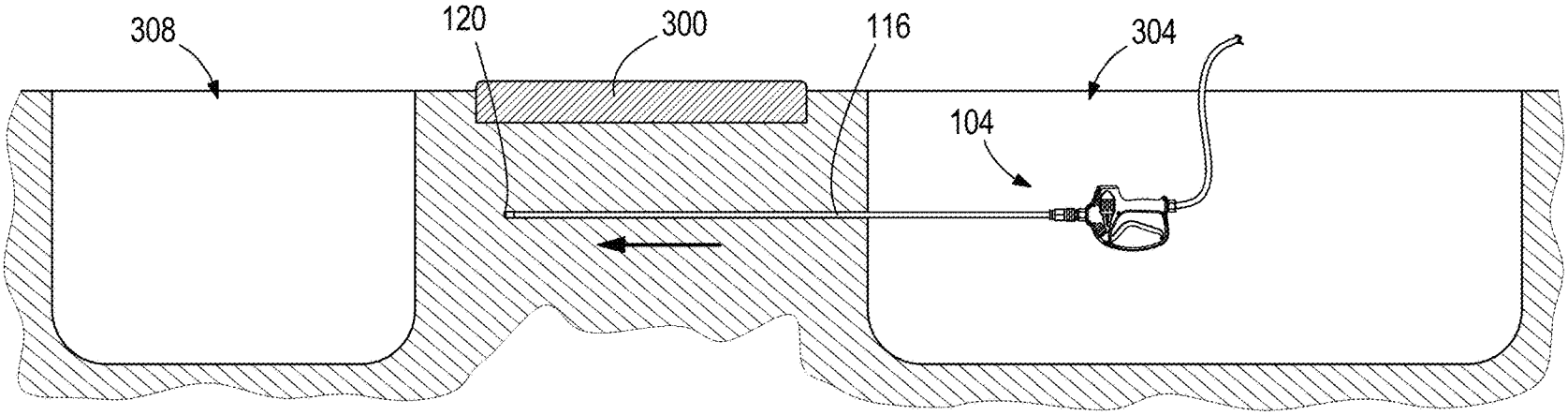
FIG. 16A illustrates the handheld water drill used in a horizontal boring operation between first and second trenches, for utility installation.

FIG. 16A illustrates another operation of the wand 104 of the system 100 or 200, which is one of boring rather than probing. The boring operation may involve a generally horizontal orientation of the longitudinal axis of the wand 104. As illustrated, an obstruction 300 may exist at the ground surface. For example, the obstruction 300 can be a driveway, sidewalk or other concrete or asphalt structure, among other things. Also, the obstruction may be another pre-existing underground utility. To avoid excavating (and keep the obstruction 300 in-tact), pits are dug on two opposite sides of the obstruction 300. The pits are dug to a depth at least as great as a desired depth of the horizontal bore desired below the obstruction 300. One pit (right) is the entrance pit 304, and the other pit (left) is the exit pit 308. Horizontal spacing between the pits 304, 308 can be relatively small (e.g., less than 10 feet, less than 8 feet, or less than 6 feet) and may be kept less than the length L. In other constructions, larger spacings can be accommodated by adding effective wand length by fitting additional shaft segments, as described in further detail below. The wand 104 is positioned in the entrance pit 304 and the distal tip portion 120 is placed in contact with the generally vertical soil wall adjacent to the obstruction 300. The operator holds the wand 104 such that the shaft 116 is horizontal (parallel to the ground). However, it is noted that some boring operations may call for probing at skewed angles rather than strictly horizontal. With the wand 104 in the desired boring orientation, the operator actuates the trigger 128. While maintaining the trigger 128 actuated, the operator manually applies thrust load to the wand 104. The wand 104 is thrust generally horizontally and thus perpendicular to the vertical soil wall in the entrance pit 304. With the trigger 128 actuated and thrust load applied, the wand 104 cuts into the soil and creates a localized path or bore approximately the diameter D2 of the distal tip portion 120. This allows for a reasonable thrust load (e.g., 54 kg (120 lbs.) or less, or 45 kg (100 lbs.) or less) to bore through the ground into the exit pit 308—up to and including the entire length L. The soil from which the bore is formed is largely not removed from the ground. Rather, it is simply broken up along the path of the probing, and generally compacted in the immediate surroundings. Any spoils that are produced simply fall into the entrance or exit pit 304, 308. Thus, the wand 104 and its use in boring as described above meet the need for a less invasive and destructive means of boring, creating only a small diameter bore and requiring substantially reduced labor effort than existing tools and methods.

Figure 16B:
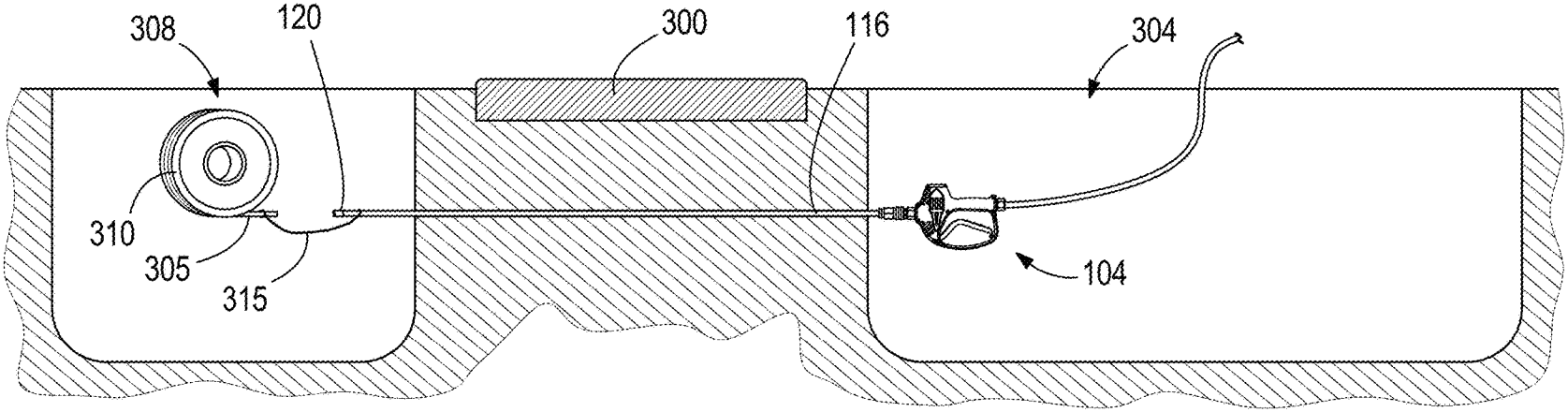
FIG. 16B illustrates a product attached to the distal end of the handheld water drill for installation into the bore hole.
Figure 16C:
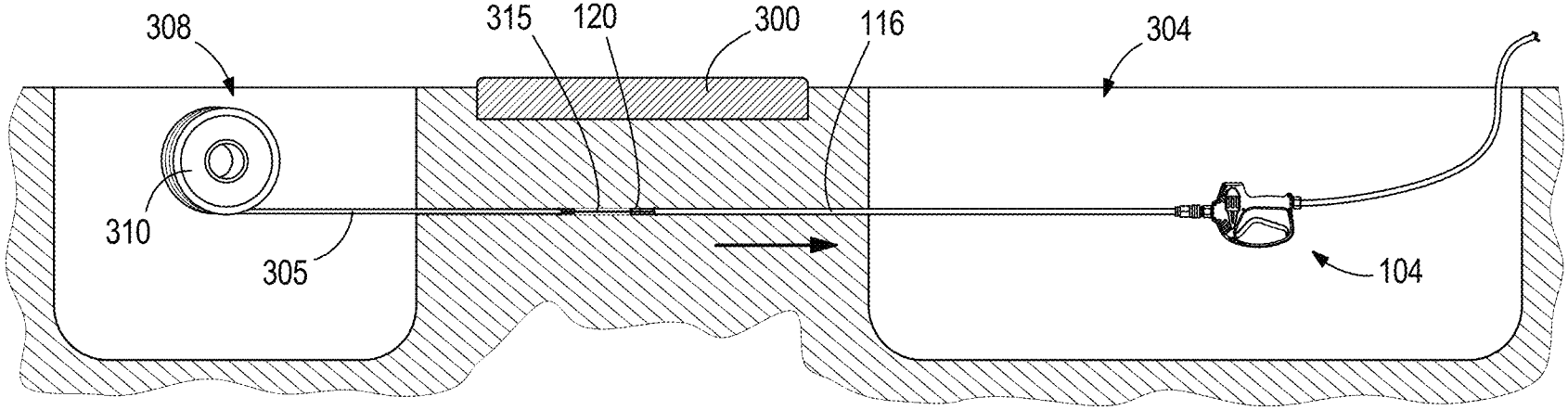
FIG. 16C illustrates the pullback of the product into the bore hole.

When the bore hole between the pits 304, 308 is completed, a product to be installed can be attached to the end of the wand 104 and pulled through the bore hole as shown in FIGS. 16B and 16C. An example product 305 is shown in FIGS. 16B and 16C, coiled on a reel 310 to unwind during pullback by the wand 104, for example by connection of a coupler 315 therebetween. The nozzle 140 can be removed for product attachment or left in place. If the nozzle 140 is removed, it may be replaced with a product attachment device. Alternative to the method shown in FIGS. 16B and 16C, the wand 104 can be pulled backward out of the newly-formed borehole directly after boring, and then the product is subsequently pushed through the bore hole. The bore hole can optionally be enlarged by additional passes (reaming the hole) or by using other nozzles (e.g., with the wand 104) that are configured for hole widening. A bore hole enlargement tip can include at least one product attachment feature so that bore hole widening and product installation can be completed concurrently. The coupler 315 for product attachment can include various slings and riggings (commercially available or fabricated on-site), or barbed push-on couplers, or any other coupler known in the art. Product to be installed can be fiber optic cable, other power and/or communication wires, or simply a conduit. As can be appreciated, an open trench is not required. This process can be followed, whether or not there exists an obstruction 300 that physically prevents trenching, e.g., anywhere minimal/no disturbance to the surface is desired (short shots to homes or buildings). The boring operation with the wand 104, excluding the formation of the pits 304, 308, avoids the removal of soil so as to be non-destructive to the original ground, including the obstruction 300.

The use of the wand 104 has been demonstrated to produce several unexpected results during probing and/or boring, and these include:

Speed of soil penetration (faster than expected)

Lack of spoils/No need for disposal (a spoils mound remaining after use of the wand can have a volume of not more than 1 liter, or even not more than 0.5 liter)

Cleaner than expected—the operator does not get blasted by water and soil due to the fast penetration rate and the small sliding spray shield 122 (unlike air knife excavation, which is very dusty).

Figure 17:
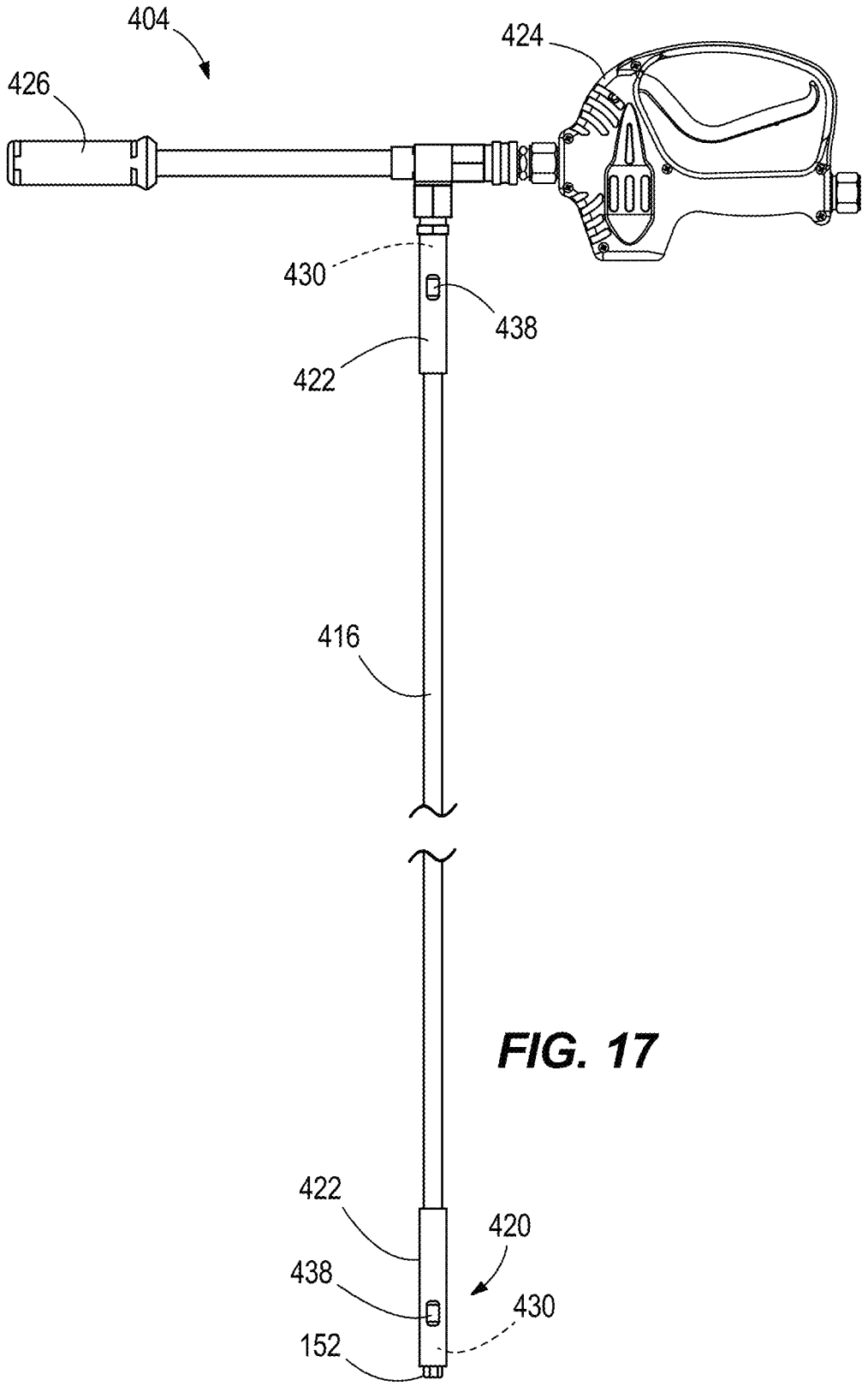
FIG. 17 illustrates a handheld water drill according to another embodiment of the present disclosure in which a T-handle is provided, along with a shaft constructed with permanently integrated end fittings.

An alternative wand 404 is shown in FIG. 17, the wand 404 sharing the features and uses of the wand 104 described above except as noted below. Features introduced in FIG. 17 can be used throughout the preceding embodiments, either together or in isolation as desired. The wand 404 has an additional handle portion 426 so that a T-shaped handle is formed for grasping and operating the wand 404. The two handle portions 424, 426 extend perpendicular to and across the shaft 416. The handle portion 426 can be a simple rod, bar, or shaft, devoid of triggering controls for the water. The handle portion 424 can be similar to the handle portion 124 and configured to control the water, at least providing ON/OFF control of the water discharge. At the distal tip portion 420, the wand 404 is configured for connection with one or more nozzles that may vary in aperture configurations to provide different spray patterns. FIG. 17 illustrates the nozzle 152 of FIGS. 11-13. The different nozzles can be selected for attachment with the wand 404 based on the job and/or conditions at hand: 1) boring versus probing may utilize different nozzles, 2) pilot holes verses hole enlargement/reaming may utilize different nozzles, 3) different earth/soil conditions may require different nozzles for efficient penetration and cutting (clay, sand, loam, and combinations thereof).

The shaft 416 is part of a multi-piece shaft assembly (also referred to as the "lance" or "wand body") that includes the shaft 416 and fittings 422 fixed at both opposite axial ends of the shaft 416. The shaft 416 can have a construction that is generally similar to the shaft 116 shown and described above, including exemplary materials and sizing, etc. As such, those details are not repeated here. The fittings 422 can be permanently affixed to the shaft 416 at one or both ends. This means that, as opposed to being constructed with connection means configured for repeated assembly and disassembly (e.g., threaded joints, quick-connects), the fittings 422 are secured to the shaft 416 by means that A) are intended to remain in-tact for the life of the wand 404 and/or B) require breakage to disconnect. In some constructions, the fittings 422 are bonded to the shaft 416. The fittings 422 can be bonded to the shaft 416 with epoxy (e.g., 2-part epoxy). Each fitting 422 can have a connection structure at the outward end thereof such as a threaded portion 430 (e.g., female pipe thread) or a quick-connector so as to facilitate repeated assembly and disassembly with adjacent structures. The threaded portion 430 or other connection structure is complementary with a connection structure provided on the adjacent component (e.g., the handle 424 on the proximal end and the nozzle 152 on the distal end). Each fitting 422 can include features 438 such as wrench flats on an exterior profile thereof so that the fitting 422 can easily be gripped for torque application for assembly and/or disassembly. In the illustrated construction, each fitting 422 has a round or circular profile with the exception of the wrench flats 438.

In some constructions, the multi-piece shaft assembly formed by the shaft 416 and the fittings 422 is bi-directional such that it can be connected between the handle portion 424 and the nozzle 152 in a first orientation and a second reversed orientation. In other words, either of the two fittings 422 can be connected to the handle portion 424 and the other fitting can be connected to the nozzle 152. However, it is also contemplated that the fittings 422 can be different from each other in construction and/or attachment to the shaft 416 at the two different ends. In some constructions, the shaft 416 may include only one permanently affixed fitting 422. In some constructions, one or both of the fittings 422 (and in some cases also the nozzle 152) is constructed of metal. Removable and exchangeable nozzles (e.g., by threaded connection or quick-connect) can be implemented in the wand 104 of the preceding embodiment as well.

Figure 18:
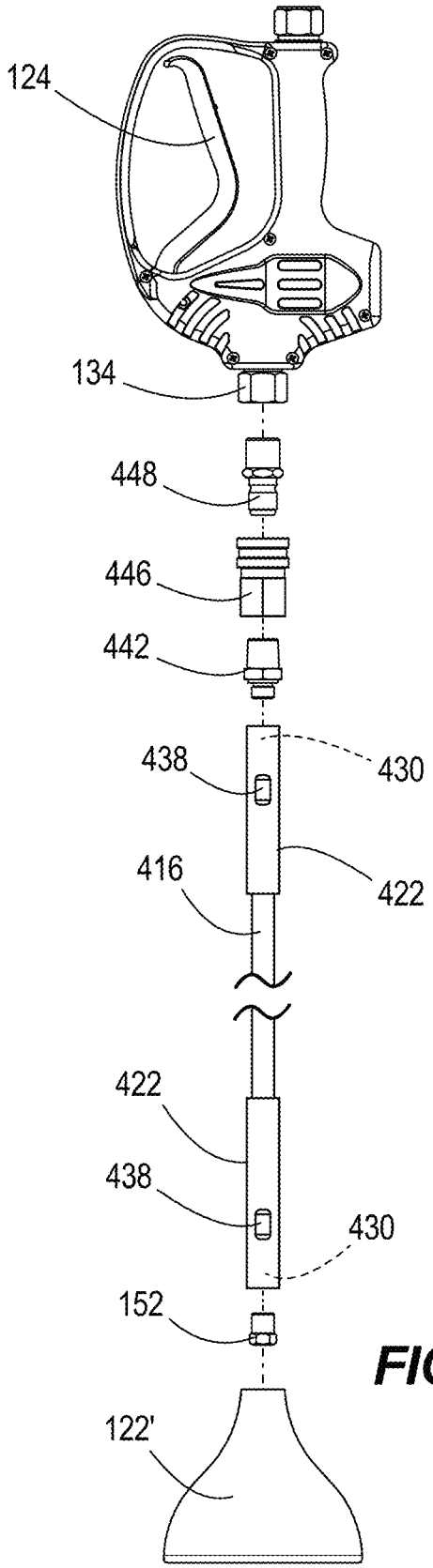
FIG. 18 is an exploded assembly view of a handheld water drill according to another embodiment, using the shaft of FIG. 17.

FIG. 18 illustrates the multi-piece shaft assembly formed by the shaft 416 and the fittings 422 used with the handle portion 124 of the preceding wand embodiment. In exploded assembly view, the multi-piece shaft assembly is shown with a direct threaded connection to the nozzle 152 at the bottom of the view. At the top of the view, an indirect connection is made between the handle connection structure 134 and the fitting 422. A thread adapter 442 is secured to the fitting 422 and acts as a pipe nipple increaser. Quick-connect adapters 446, 448 are threaded to the thread adapter 442 and the handle connection structure 134, respectively. The overall wand assembly of FIG. 18 is also illustrated with an alternate spray shield 122' having an elongated taper section for engaging the multi-piece shaft assembly.

Figure 19:
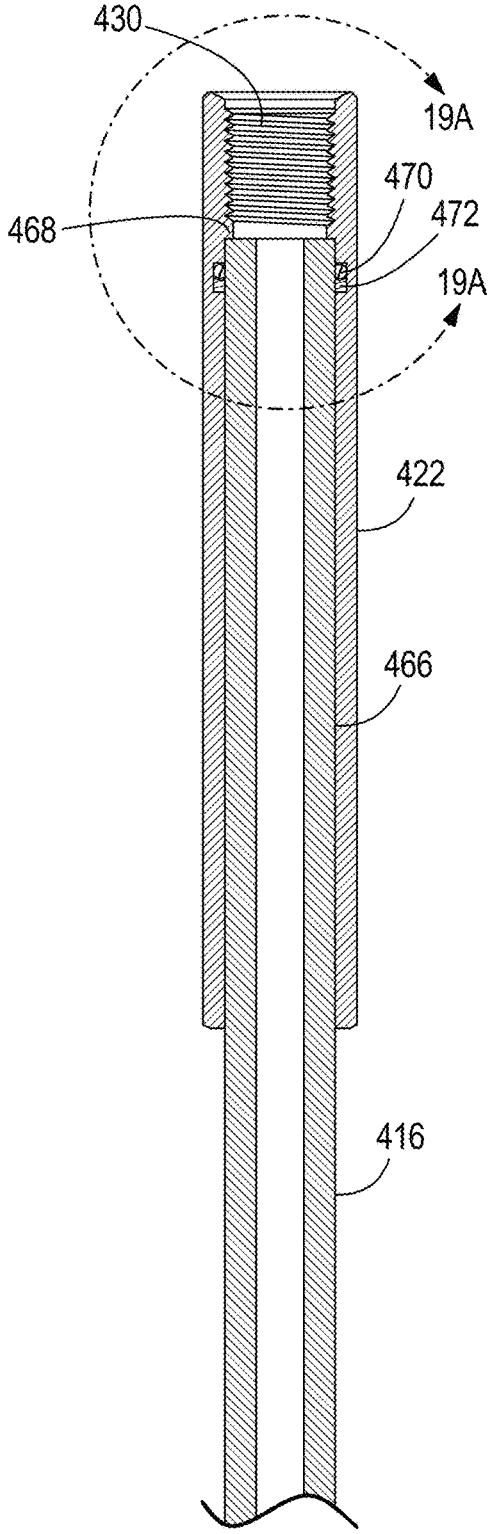
FIG. 19 is a cross-section view taken through the shaft and end fitting of FIGS. 17 and 18.
Figure 19A:
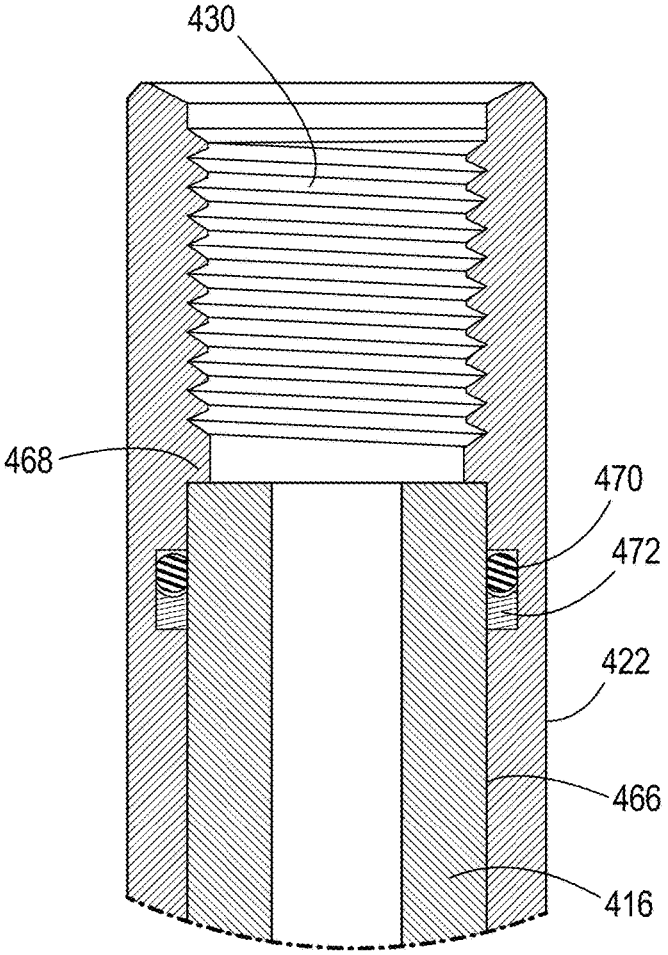
FIG. 19A is a detail view of a portion of the cross-section of FIG. 19.

FIGS. 19 and 19A illustrate a cross-section of the shaft 416 and one of the fittings 422 permanently affixed (e.g., bonded) thereto. As shown there, the fitting 422 has a first portion provided with the threaded portion 430. The threaded portion 430 is open to the environment at one end and open to a shaft-receiving portion at the other end. At the shaft-receiving portion, the fitting 422 provides an inner cylindrical surface configured to receive and form an interface 466 with the outer cylindrical surface of the shaft 416. The shaft 416 and the fitting 422 are bonded (e.g., with epoxy) along all or a portion of their interfacing cylindrical surfaces. The bonded interface 466 can extend along a greater axial length than the threaded portion 430. Although the shaft 416 can be inserted fully into the fitting 422 (up to an internal shoulder 468 formed between the threaded portion 430 and the shaft-receiving portion), water at high pressure may get between the shaft 416 and the fitting 422. Adjacent the shoulder 468 and the end of the shaft 416, a seal structure is provided to seal the bonded interface from the interior of the shaft 416. The seal structure in the illustrated embodiment includes an O-ring 470 and a back-up ring 472. The O-ring 470 acts a seal between the shaft 416 and the fitting 422, and the back-up ring 472 provides mechanical support and protection to the O-ring 470.

Figure 20:
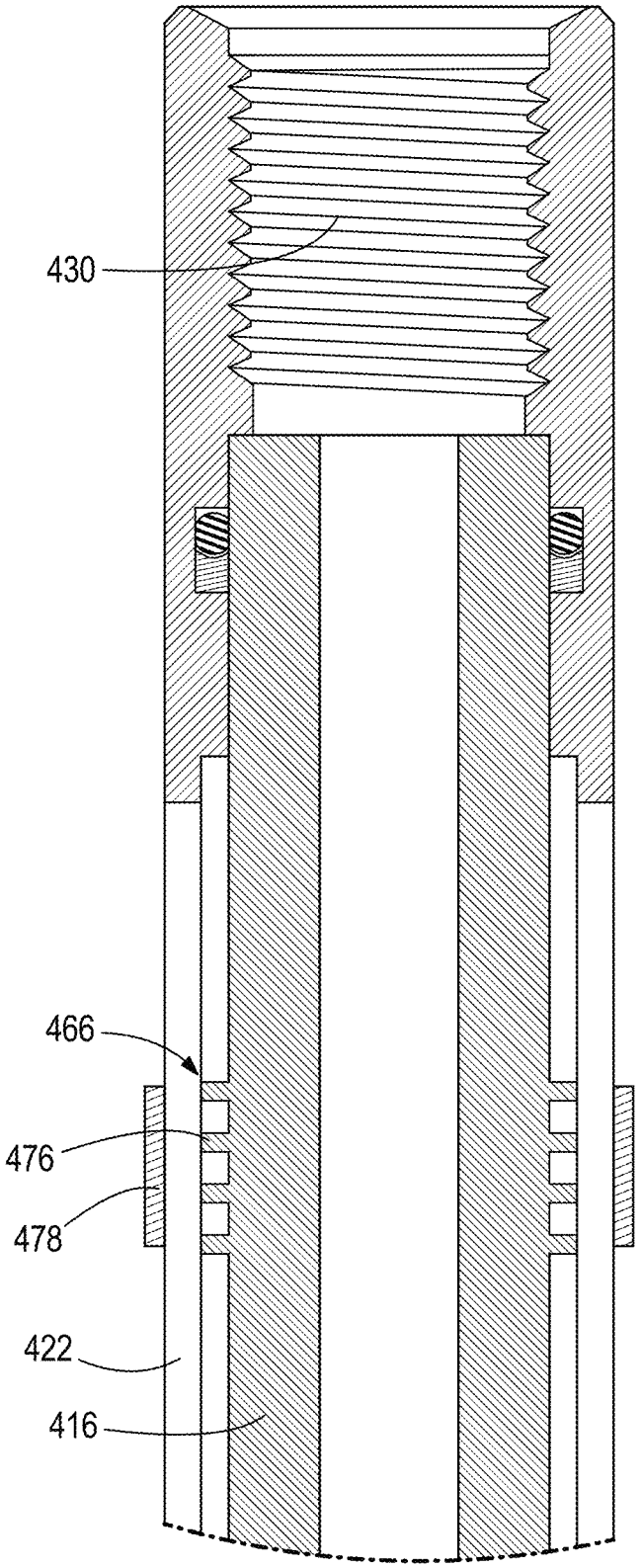
FIG. 20 is a cross-section view showing an optional ribbed and clamped interface for joining the shaft and end fitting.

FIG. 20 illustrates an optional configuration in which the shaft 416 is provided with ribbing 476 in the form of radial projections or barbs. The ribbing 476 can be formed by manufacturing the shaft 416 with an enlarged end section and then selectively removing material (e.g., by machining). The ribbing 476 is exaggerated in FIG. 20 for clarity. The ribbing can include more or fewer structures than the three shown. In lieu of or in addition to bonding, the interface 466 between the shaft 416 and the fitting 422 can be mechanically secured by applying clamping load with a clamp 478 around the fitting 422 at the axial location of the ribbing 476. In some constructions, the ribbing 476 can be provided internally on the fitting 422 to face toward the outside of the shaft 416. The clamp 478 can take any suitable form, including a hose clamp, spring clamp, band clamp, pipe clamp, etc. As illustrated by the lack of cross-hatching, a portion of the fitting 422 can be slit axially to facilitate inward clamping deflection. When clamped, the ribbing 476 at the interface 466 bites into the adjacent material to increase the mechanical strength of the joint. This type of interface 466, which may lack any separate bonding material between the shaft 416 and the fitting 422, can be self-sealing and having no separate seal. Alternatively, a separate seal may be provided (e.g., the O-ring 470 and back-up ring 472).

Although the bonded and/or clamped interface 466 has proven successful, there remain additional optional constructions for making end connections on the shaft 416, and some of these are listed below. Those of skill in the art will realize that each connection method can be carried out in a variety of ways, and may be material dependent in some aspects. In one construction, the fitting 422 is threaded to the shaft 416. In other constructions, the fitting 422 is shrink-fit or crimped to the shaft 416 (e.g., similar to the construction of hydraulic hoses/fittings). In yet another construction, the fitting 422 can be cast, melted, or welded into or onto the shaft 416. In some cases, the shaft 416 and the fitting 422 are manufactured from the same material and bonded with hot melt adhesive. In yet other constructions, the fitting 422 is embedded (e.g., by pultrusion) or shrink fit to the shaft 416. In another construction, the fitting 422 has an integrated shaft collar style clamp that is operable to squeeze onto the shaft 416. Some or all of the above may be used for connecting the shaft 416 with the nozzle 152 or other structure, without the fitting 422 as an intermediary. In yet another construction, the distal tip 420 is provided without a separate nozzle, and the nozzle aperture(s) are formed directly in the material of the shaft 416. As such, the shaft 416 can be manufactured with a solid end and then machined (e.g., drilled) to provide the nozzle apertures. Alternately, the end of the shaft 416 can be provided (e.g., cast, molded) with the nozzle apertures at the time of original manufacture. Silicon nitride material may be used to facilitate certain manufacturing processes noted above, as it may be machined and/or welded in some cases.

Figure 21:
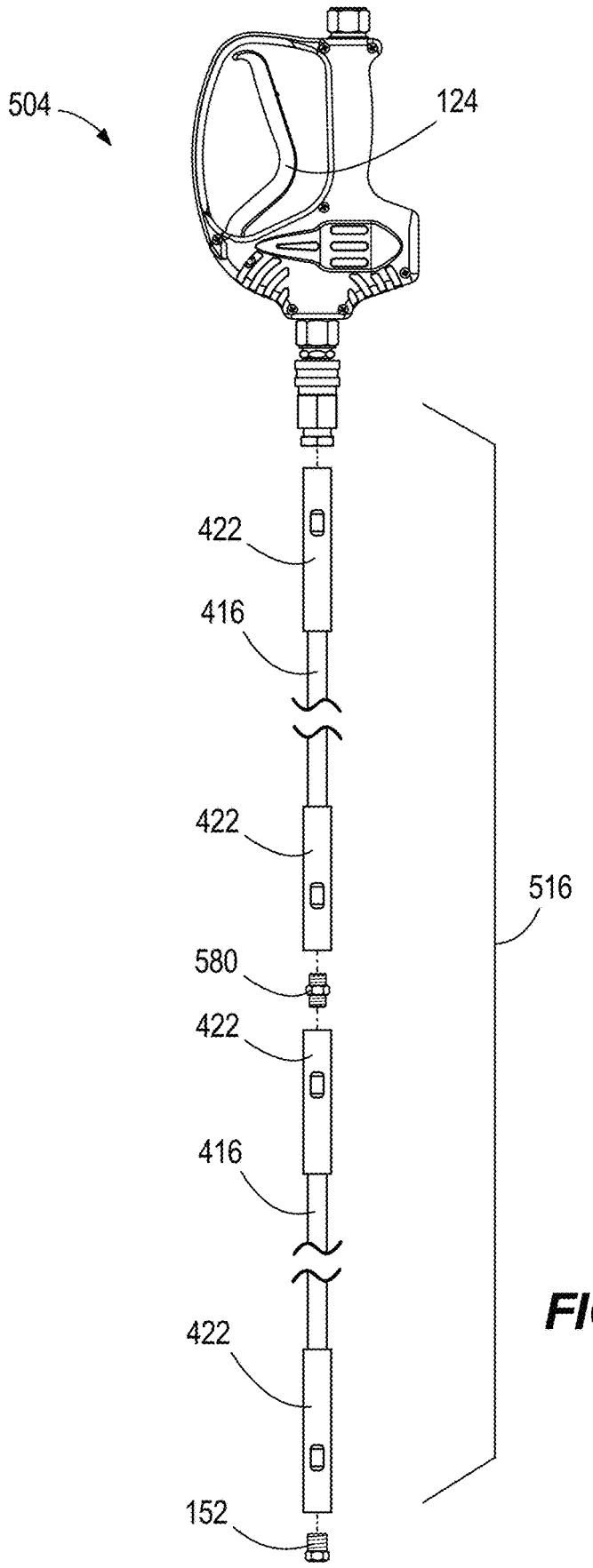
FIG. 21 is a view of a wand shaft made up of multiple shaft segments.

FIG. 21 illustrates a wand 504 built with a handle portion 124 and a plurality of separable shafts or shaft sections to form the lance or wand body as a shaft string 516. In other words, the total length of the lance or wand body is the combined length of the connected shafts. As illustrated, the wand 504 includes a plurality of the of the multi-piece shaft assemblies of FIGS. 17-20, each including a shaft 416 and two end fittings 422. The shaft string 516 can be constructed from shafts of other constructions, including various embodiments disclosed elsewhere herein. Referring specifically to FIG. 21, a first shaft assembly is coupled to the handle portion 124 and a second shaft assembly is coupled to the nozzle 152. The first and second shaft assemblies are coupled to each other with at least one coupler fitting 580, for example a double pipe nipple. One threaded portion of the coupler fitting 580 is engaged with the distal fitting 422 of the first shaft assembly, and the other threaded portion of the coupler fitting 580 is engaged with the proximal fitting 422 of the second shaft assembly. The coupler fitting 580 can have an outer diameter that is equal to or less than the outer diameter at the distal tip (e.g., the nozzle diameter). In some constructions, the outer diameter of the coupler fitting 580 is equal to or less than the nominal outer shaft diameter D1 so as to avoid any bulging or increase in the outer diameter when traversing the length of the shaft. This type of shaft string 516 can be used in any of the wands and any of the methods described in the present disclosure. Rather than a singular, contiguous shaft as shown in the preceding embodiments, the shaft string 516 is made up of multiple (e.g., at least two, but optionally three, four or more) shaft segments connectable together for use in connecting a handle portion to a nozzle at the distal tip. As noted above, each fitting 422 provides a connection structure via the threaded portion 430. In other constructions, the shaft sections can be provided with alternate connection structures (threaded or otherwise) to enable connection of the multiple shaft sections in forming the wand body. In this way, the length of the wand to be used by the operator can be selected by the operator and can optionally be increased or decreased during a particular job. Storage and transport of the wand can be made easier by allowing the disassembly of the shaft sections.

Figure 22:
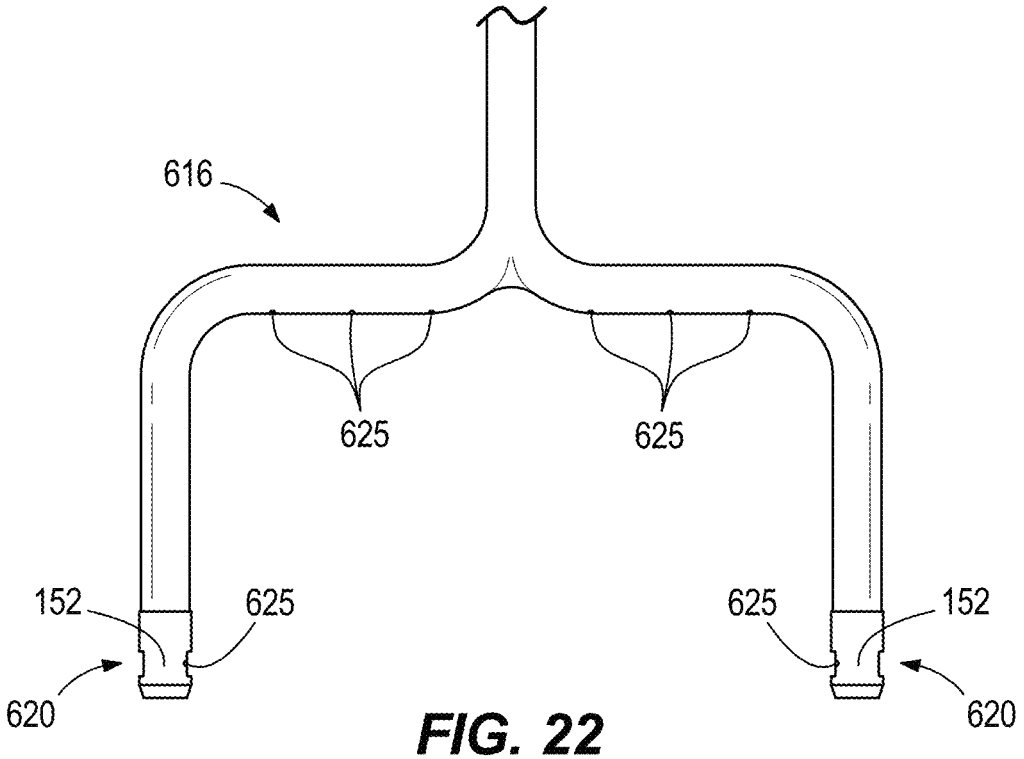
FIG. 22 is a view of a forked wand shaft according to one embodiment.
Figure 23:
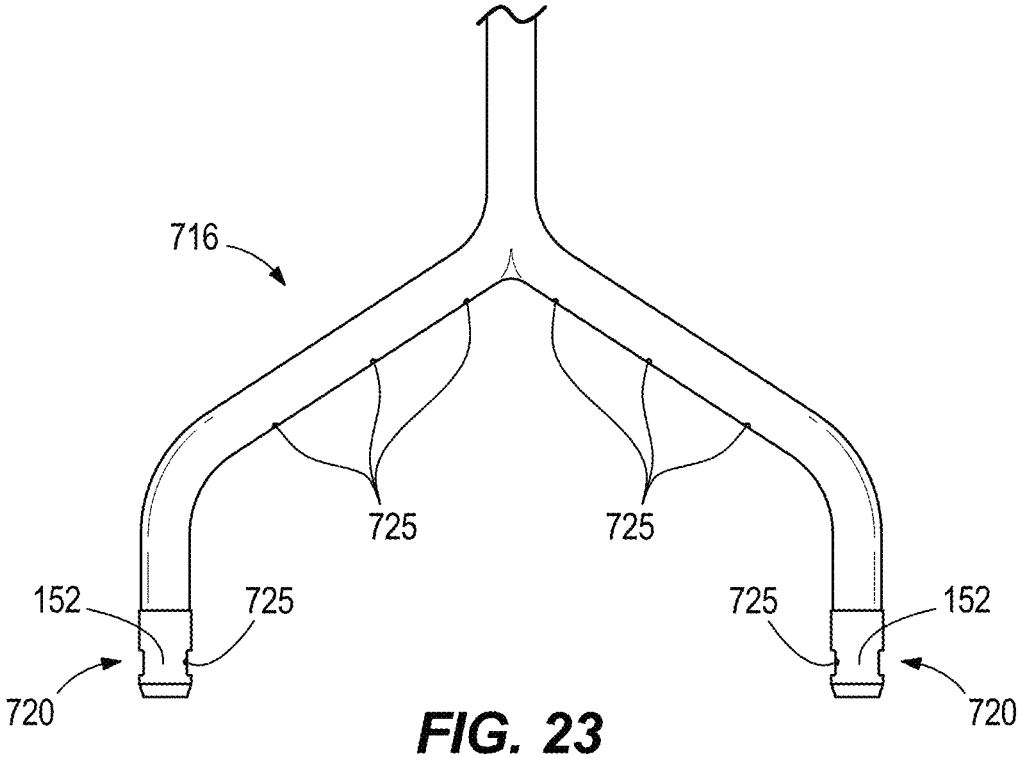
FIG. 23 is a view of a forked wand shaft according to another embodiment.

FIGS. 22 and 23 illustrate alternate wand bodies that are constructed with shafts 616, 716 that are forked at the distal end so as to provide multiple (e.g., two) "tines" extending to multiple distal tips 620, 720, each distal tip having a nozzle (e.g., nozzle 152). The forked portions can have various shapes (including straight and/or angled sections), two of which are depicted in FIGS. 22 and 23. In FIG. 22, each tine of the fork has a proximal portion angled 90 degrees outward from the longitudinal axis, the proximal portion extending to a distal portion through an additional bend back 90 degrees so the distal portion is parallel to the longitudinal axis. In FIG. 23, the proximal portion of each tine of the fork is angled 60 degrees outward from the longitudinal axis. There may be multiple upstream water discharge holes 625, 725 along the top and/or sides, along with the nozzle apertures at the tips 620, 720 of the forks. The fork may be configured in various widths, from a narrow spacing between the tines (e.g., 19 mm (¾ inch), 25 mm (1 inch), or 32 mm (1.25 inches)), to a wide spacing between the tines (e.g., up to 305 mm (12 inches)). The tine length can vary from just the length of a nozzle to longer lengths (e.g., 76 mm (3 inches) to 305 mm (12 inches)). Longer tines may provide additional space for a plurality of additional water discharge holes along the inside, prior to the nozzle at the distal tip. The forked probe may be used for initial utility locating or cleaning and probing within an existing hole/excavation. In some cases, a wand having the shaft 616, 716 forms at its distal end a yoke that may be used to catch a utility therein after piercing into the soil. The shafts 616, 716 may be composed of materials similar to the other shafts described herein. Other than the particular variations noted herein, the shafts, nozzles, etc. of FIGS. 22 and 23 can conform to the preceding disclosure.

Although the invention has been described in detail with reference to certain preferred embodiments, variations and modifications exist within the scope and spirit of one or more independent aspects of the invention as described. Although it should be apparent from the foregoing, various structures and features of the different embodiments disclosed in the preceding embodiments can be combined in any number of combinations, resulting in additional embodiments. For the sake of brevity, not every possible combination of features is explicitly illustrated and described herein.

What is claimed is:

1. A water drilling system comprising:

a handheld wand having a handle portion and a distal tip;

a pressurized water source; and a hose connecting the handheld wand and the pressurized water source, wherein the handheld wand is controllable to selectively discharge pressurized water from a nozzle at the distal tip, wherein a non-metallic hollow shaft of the handheld wand is configured to be thrust into ground soil, the hollow shaft extending between the handle portion and the distal tip, the hollow shaft having an outside diameter less than an outside diameter of the distal tip, wherein the outside diameter of the hollow shaft is no more than about 19 mm (0.75 in), and wherein the distal tip is formed solely by the nozzle, and a ratio of the outside diameter of the distal tip to the outside diameter of the hollow shaft is at least 1.1 and not more than 2.0.

2. The water drilling system of claim 1, wherein the ratio is not more than 1.5.

3. The water drilling system of claim 1, wherein the ratio is in a range of 1.15 to 1.40.

4. The water drilling system of claim 1, wherein the ratio is in a range of 1.2 to 1.3.

5. The water drilling system of claim 1, wherein the hollow shaft is part of a multi-piece shaft assembly constructed with one or more permanently affixed end fittings.

6. The water drilling system of claim 5, wherein the nozzle attaches to the hollow shaft with a threaded connection to a distal one of the one or more permanently affixed end fittings.

7. The water drilling system of claim 1, wherein the hollow shaft has an electrical resistivity of at least 1000 Ωm.

8. The water drilling system of claim 1, wherein the hollow shaft is made of fiberglass.

9. The water drilling system of claim 1, wherein the hollow shaft is made of PEEK.

10. The water drilling system of claim 1, wherein the outside diameter of the hollow shaft is in a range of 9.5 mm (0.375 in.) to 15.9 mm (0.625 in.).

11. The water drilling system of claim 1, wherein the nozzle includes a plurality of nozzle apertures, each of which is oriented at a divergent angle of 6 to 12 degrees from a central axis of the hollow shaft and the nozzle.

12. A method of operating a water drilling system comprising:

connecting a hose to a handheld wand having a handle portion and a distal tip, the hose supplying pressurized water into the handheld wand;

operating a trigger at the handle portion to selectively discharge the pressurized water from a nozzle that solely forms the distal tip, wherein the pressurized water is conveyed through a non-metallic hollow shaft that connects the handle portion and the distal tip, the hollow shaft having an outside diameter that is no more than about 19 mm (0.75 in) and is less than an outside diameter of the distal tip, and a ratio of the outside diameter of the distal tip to the outside diameter of the hollow shaft is at least 1.1 and not more than 2.0; and while operating the trigger, thrusting the distal tip and the hollow shaft of the handheld wand into the ground, and probing to locate an underground utility by contact therewith during the thrusting.

13. The method of claim 12, further comprising adjusting water pressure of the pressurized water based on soil conditions of the ground.

14. The method of claim 12, wherein the pressurized water is at least 69 bar (1000 psi).

15. The method of claim 12, wherein the pressurized water is discharged from the nozzle through inner and outer apertures having different angular orientations with respect to a central axis of the wand.

16. The method of claim 12, further comprising exchanging the nozzle for an alternate nozzle providing a different spray pattern based on application and/or soil type.

17. The method of claim 12, wherein an entire length of the wand, up to the handle portion, is thrust into the ground in less than 30 seconds.

18. The method of claim 12, further comprising leaving the ground as-is, without any remedial processing following the thrusting and probing with the wand to locate the underground utility.

19. The method of claim 12, wherein, following thrusting and removal of an entire length of the wand, up to the handle portion, a volume of spoils ejected from the ground does not exceed 1 liter.

20. The method of claim 12, wherein, following a 152 mm (6 inch) penetration of the distal tip of the wand below a surface of the ground, no spoils are ejected from the ground as the distal tip continues to reach greater depth during thrusting.

21. A method of operating a water drilling system comprising:

connecting a hose to a handheld wand having a handle portion and a distal tip, the hose supplying pressurized water into the handheld wand;

operating a trigger at the handle portion to selectively discharge the pressurized water from a nozzle at the distal tip, wherein the pressurized water is conveyed through a non-metallic hollow shaft that connects the handle portion and the distal tip; and while operating the trigger, thrusting the distal tip and the hollow shaft of the handheld wand into the ground, wherein thrusting the distal tip and the hollow shaft of the handheld wand into the ground includes boring horizontally from an entrance pit to an exit pit for installation of an underground utility.

* * * * *